United States Patent [19]

Zitz et al.

[11] Patent Number: 4,696,518

[45] Date of Patent: Sep. 29, 1987

[54] CUTTING MACHINE

[75] Inventors: Alfred Zitz; Wilfried Maier, both of Zeltweg, Austria

[73] Assignee: Voest-Alpine Aktiengesellschaft, Linz, Austria

[21] Appl. No.: 818,750

[22] Filed: Jan. 14, 1986

[30] Foreign Application Priority Data

Jan. 21, 1985 [AT] Austria ..... 139/85

[51] Int. Cl.[4] ..... E21C 25/00; E21B 10/60

[52] U.S. Cl. ..... 299/75; 299/81

[58] Field of Search ..... 299/75, 81, 12, 17

[56] References Cited

U.S. PATENT DOCUMENTS

| | | | |
|---|---|---|---|
| 3,799,615 | 3/1974 | Taylor et al. | 299/81 X |
| 4,162,104 | 7/1979 | Kogler et al. | 299/75 |
| 4,289,357 | 9/1981 | Hintermann et al. | 299/81 |
| 4,470,636 | 9/1984 | Paurat et al. | 299/81 |

FOREIGN PATENT DOCUMENTS

| | | | |
|---|---|---|---|
| 2749409 | 5/1978 | Fed. Rep. of Germany | 299/81 |
| 2019920 | 11/1979 | United Kingdom | 299/81 |

*Primary Examiner*—Stephen J. Novosad
*Assistant Examiner*—Bruce M. Kisliuk
*Attorney, Agent, or Firm*—Cushman, Darby & Cushman

[57] ABSTRACT

In a cutting machine (1) comprising cutting heads (5) rotatably supported on a universally swivellable cutting arm (2) and having arranged therein a gearing stage (7), supply of water is effected via the outer front disc (8) of the cutting head and the water flows via passages provided within the interior of the main body (15) of the cutting head to nozzles provided at the circumference thereof. The water supply flows via an essentially axial bore (12) into a cavity of the main body (15) of the cutting head and is passed from this cavity via passages (21, 22, 23) to the nozzles (FIGS. 1,2).

13 Claims, 3 Drawing Figures

CUTTING MACHINE

BACKGROUND OF THE INVENTION

1. Field of the Invention

The invention refers to a cutting machine comprising a cutting arm being swivellable in height direction and in lateral direction and being equipped with cutting heads rotatably supported for rotation around an axis transversely extending relative to the axis of the cutting arm and being driven for rotation by means of a cutting gearing, in which cutting machine the cutting heads are equipped with bits and with nozzles for spraying water and conduits for the supply of water to the nozzles are provided.

2. Description of the Prior Art

For the purpose of cooling the mine face or, respectively, for precipitating dust formed during cutting work, it is already known to supply water into the interior of cutting heads via an universally swivellable cutting arm. Complicated constructions have become known in particular in connection with embodiments having the last gearing step for driving the rotatably supported cutting heads housed within the interior of cutting heads of hollow design, and the main problem of these constructions resided in reliably providing a tight connection between the rotatably supported cutting head and the rigid portion of the supply conduit for water. Any difficulties with the sealings have, within this area, as a result that cooling water may flow into the gearing lubricant, so that wear of the gearing is substantially increased and the lubricating capacity of the lubricating oil is lost.

SUMMARY OF THE INVENTION

The invention now aims at completely evading the critical range of the gearing when supplying with water the nozzles for a cutting head. For solving this task, the invention essentially consists in that the supply conduit for water opens into a front disc rotatably supported for rotation around the axis of rotation of the cutting heads, in that the supply conduit for water is in sealing connection with an axial cavity of the cutting head via an essentially axial bore of the front disc and in that the axial cavity of the cutting head is connected with the nozzles via passages provided within the interior of the cutting head. While in constructions known up till now, the supply conduit for water had to pass into the cutting head outside of the greatest diameter of the gearing and thus at a relatively great radius and therefore required a sealing arrangement of reliable sealing capacity at high relative speed, supply of water can now be effected at a nearly central location and the relative speeds at the sealing area are substantially smaller. The use of a front disc being rotatable relative to the cutting head allows to rotatably support this front disc in a manner which results in a reliable sealing effect even in case of high load acting on the cutting head. In contrast thereto, any sealing arrangement provided for supplying cooling liquid via the cutting head from the interior of the cutting head was never completely free of the vibrations of the cutting head during cutting work, so that it was scarcely impossible to prevent leakage of the sealing arrangement with lapse of time.

The inventive arrangement is also suitable to realize any desired sector control, for which purpose the arrangement is preferably such that the axial bore of the front disc opens into a bushing non-rotatably and sealingly connected with the front disc and rotatably supported within the axial cavity of the cutting head and sealingly supported within the axial cavity of the cutting head and having at least one radially extending perforation being, during rotation of the cutting head, in alignment with passages provided within the cutting head for supplying the water to the nozzles of the cutting head. Said both constructional parts, i.e. bushing and front disc, can constructionally be separated one from the other and are, according to a preferred development of the invention, connected one with the other by a piece of tube being sealingly inserted for axial limited shifting movement into the axial bore of the front disc and sealingly engaging with its free end a cylindrical bore of the bushing. Such a construction has as a result that the front disc can, in case of vibrations of the cutting head, be moved for a small extent fromt its axial position without detracting from the sealing function. The piece of tube inserted between front disc and bushing can effect a correspondingly sealing compensation even in case of high mechanical load.

In an advantageous manner, the front disc is supported on the cutting head by means of radial ball bearings comprising crowned bearing surfaces and being designed as pivot bearings. This feature allows for small inclined positions of the front disc relative to the cutting head and reduces thus the mechanical stress of the water supply conduits arranged outside of the cutting head.

In an advantageous manner, the water supply conduit can be held on a carrier pivotally supported on the cutting arm for swivelling movement within a plane extending in parallel relation to the longitudinal direction of the cutting arm, which makes it possible to effect maintenance work, in particular when interchanging sealing elements, by simple downward tilting of the water supply conduit. In this case, the carrier for the water supply conduit can be designed as a rocker lever swivellable on the cutting arm around an axis crossing the axis of rotation of the cutting heads and comprising guard plates for the water supply conduit. For making sure that the cutting arm is fully swivellable without running the risk of a collision of the water supply conduit with lateral boundaries of the gallery or, respectively, the drift, the water supply conduit advantageously laterally joins the front disc, the water supply conduit preferably being connected to the front disc in an off-center position and to an axial bore of this front disc via an essentially radial bore of the front disc. In an advantageous manner, the water supply conduit includes, in this case, an angle of more than 45° with the axis of rotation at the area of connection to the front disc and is immediately outside of the envelopping curve of the cutting head bent in direction of the tangent lines to the envelopping curve. A further simplification of maintainance work results if the water supply conduit being bent within a plane including the axis of rotation of the cutting head is connected with the conduit held within the carrier connected with the cutting head by means of a releaseable coupling and is preferably designed as a steel pipe at least till the coupling location.

For keeping low the mechanical stress of such mechanically stabilized supply conduits, the front disc has, in an advantageous manner, an outwardly protruding annular rim engaging the cutting head with interposition of a slip ring sealing. On account of the pivot bearing, the front disc can be supported to effect within certain limits a tumbling movement and, for keeping free from any eccentric load the bushing arranged within the interior of the axial cavity of the cutting head, the bushing is advantageously coupled to the front disc via claws.

The front disc itself can in an advantageous manner be rotatably supported on the cutting head by means of a pivot bearing supported on the outer side of the front disc adjacent the annular rim.

BRIEF DESCRIPTION OF THE DRAWING

In the following, the invention is further explained with reference to an embodiment shown in the drawing.

In the drawing.

DETAILED DESCRIPTION OF THE PREFERRED EMBODIMENT

Figure 1:
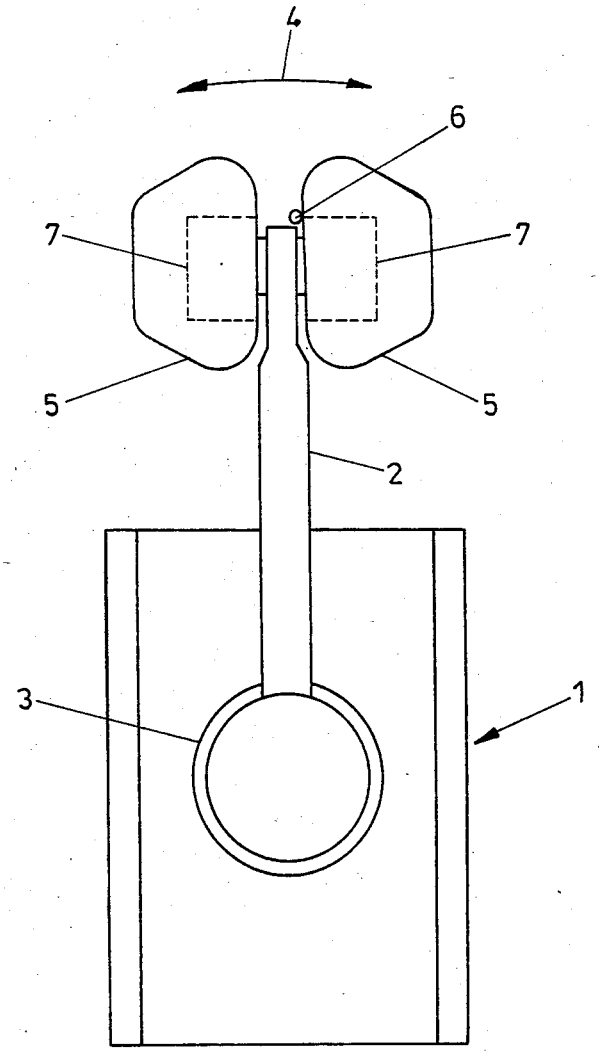
FIG. 1 (PRIOR ART)
FIG. 1 shows a schematical top plan view of a cutting machine.

In FIG. 1, a cutting machine designated by 1 has its cutting arm 2 linked to a traversing gear 3 for being swivelled in height direction and for being swivelled in lateral direction in the sense of the twin-arrow 4. The outermost end of the cutting arm 2 carries at its sides two rotatably supported cutting heads 5. In known arrangements, supply of water into the interior of the cutting head is effected at the location schematically designated by 6. Within the interior of the cutting head there is indicated with dashed lines the corresponding last reduction stage, designated by 7, of the gearing for driving the cutting heads 5.

Figure 2:
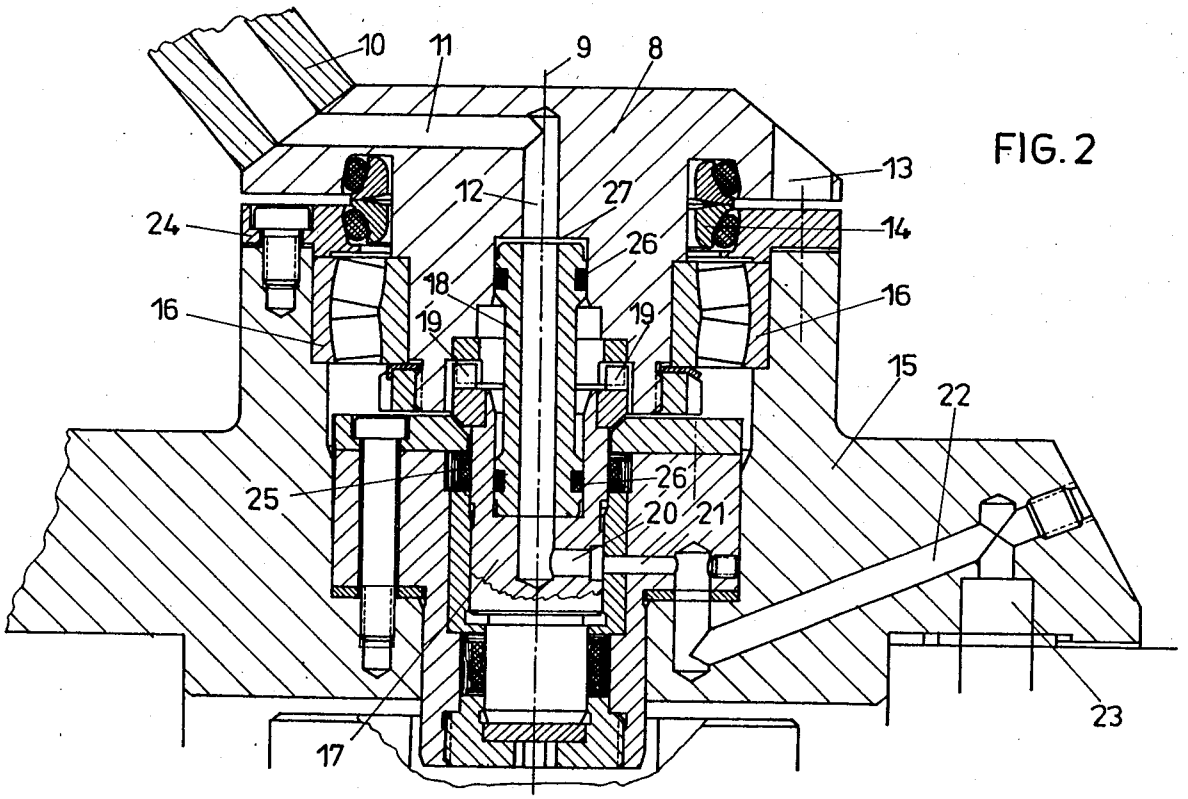
FIG. 2 shows in detail and in an enlarged scale a front disc comprising the water supply mens for the cutting head and FIG. 3 shows in a top plan view a portion of a cutting head together with the water supply means fixed to the cutting arm.

In most cases, the cutting head 5 is composed of a plurality of discs and the outermost front disc located remote from the cutting arm 2 and provided according to the invention is shown in FIG. 2 in an enlarged scale.

The front disc is designated by 8 in FIG. 2 and has outside of its axis 9 a connection piece 10 for the water supply conduit. The connection piece 10 is, via a radial passage 11, in connection with an axial bore 12 within the front disc. The front disc 8 has an annular rim 13 which is supported on the main body 15 of the cutting head with interposition of a slip ring sealing 14. The bearing of the front disc 8 is designated by 16 and designed as a pivot bearing. Within the interior of the main body 15 of the cutting head, the axial bore 12 opens into a bushing 17, noting that a tubular intermediate piece 18 having sealing function is provided for avoiding eccentric load of the bushing 17. The bushing 17 is coupled with the front disc 8 by means of claws 19, so that, if the main body 15 of the cutting head is rotating and the front disc 8 is at rest, also the bushing 17 is secured against rotation. The bushing 17 has at least one radial perforation 20 which during rotation of the main body 15 of the cutting head, comes in alignment with radial passages 21 of the main body 15 of the cutting head, said radial passages 21 distributing cooling liquid via passages 22 and 23 to the nozzles of the cutting head.

The stationary bearing box, which is held within the main body 15 of the cutting head, of the pivot bearing 16 is secured in position by a ring 24 screwed onto the main body of the cutting head.

The bushing 17 has sealing surfaces cooperating with sealing elements 25. The tubular intermediate piece extends into a cylindrical cavity of the bushing and has at its ends sealings 26. The opposite end, which extends into a cavity 27, being aligned with the axial bore 12, of the front disc 8, is equally equipped with sealings 26.

Figure 3:
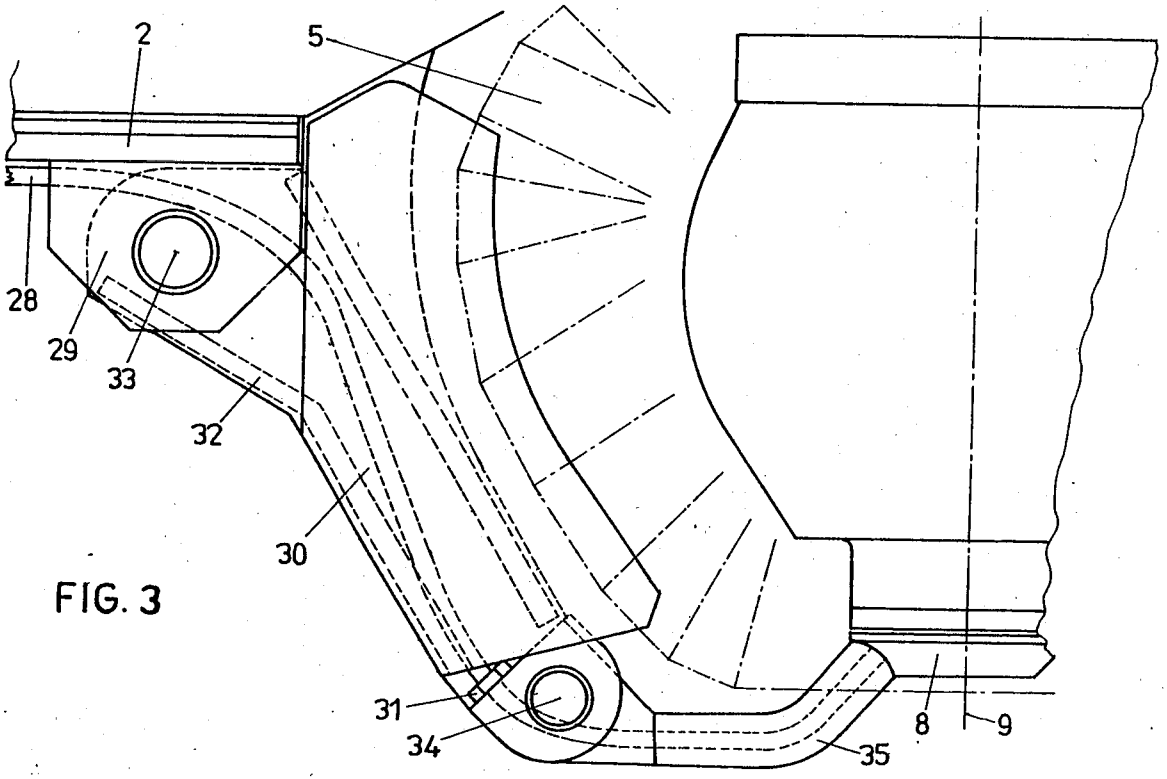

As can be seen in FIG. 3, a water supply conduit 28 is fixed to the cutting arm 2 and is passed over a lug 29 and is bent in direction to the front disc 8 outside of the envelopping curve of the cutting head 5. That portion of the water supply conduit 28, which extends outside of the enveloping curve of the cutting head, is secured by guard plates 30 and has a connecting piece 31 in proximity of the front disc 8. The guard plates 30 form in combination with the carrier 32 a rocker lever which can be swivelled around the axis 33 provided within the lug 29. After having loosened the connection piece 31, the water supply conduit 28 can be swivelled away, noting that the operating position can be secured by means of a bolt 34 provided within a further lug. Downstream of the connecting piece 31, the water supply conduit passes over, outside of the envelopping curve, into a partial area 35 which joins the front disc 8 at an off-centered location with an angle of approximately 45° relative to the axis 9 of the front disc 8.

What is claimed is:

1. In a cutting machine: a cutting arm which is swivellable in height direction and in lateral direction; at least one cutting head rotatably supported on said cutting arm for rotation about an axis transverse to the axis of the cutting arm, said cutting head having internal gearing for driving the same and having external cutting bits and water spray nozzles, and said cutting head being composed of a plurality of discs arranged coaxially with said transverse axis, one of which discs is an outermost disc located remote from said cutting arm relative to other discs and can remain stationary while the rest of the cutting head rotates; and a water supply system for supplying water to the nozzles, said water supply system comprising an axial cavity in said cutting head, a stationary water supply conduit having a discharge end and an essentially axial bore in said outermost disc placing said discharge end of said water supply conduit in communication with said axial cavity in said cutting head.

2. A cutting machines as in claim 1, wherein said cutting head has passages for supplying water to said nozzles and wherein the axial bore of the outermost disc opens into a bushing non-rotatably and sealingly connected with the outermost disc and rotatably supported within the axial cavity of the cutting head and sealingly supported within said axial cavity and having at least one radially extending perforation which, during rotation of the cutting head comes into alignment with said passages which are provided within the cutting head for supplying water to the nozzles of the cutting head.

3. A cutting machine as in claim 2, wherein said bushing has a cylindrical bore and wherein, into the axial bore of the outermost disc, there is sealingly inserted for axially limited shifting movement a tubular piece having a free end which sealingly engages said cylindrical bore in the bushing.

4. A cutting machine as in claim 1 wherein the outermost disc is supported on the cutting head by means of radial bearings comprising spherical bearing surfaces.

5. A cutting machine as in claim 1 wherein the water supply conduit is held on a carrier pivotally supported on the cutting arm for swivelling movement within a plane extending parallel to the longitudinal direction of the cutting arm.

6. A cutting machine as in claim 5 wherein the carrier for the water supply conduit includes a lever swivellable on the cutting arm around an axis crossing the axis of rotation of the cutting head and comprising protective plates for the water supply conduit.

7. A cutting machine as in claim 1 wherein the water supply conduit is connected to the outermost disc at an off-centered location and is connected to the axial bore of the outermost disc via a substantially radial bore within the outermost disc.

8. A cutting machine as in claim 1 wherein the water supply conduit includes at a location for connection to the outermost disc an angle of more than 45° with the axis of rotation and is immediately outside of an enveloping curve of the cutting head bent in direction of the tangent lines to the enveloping curve.

9. A cutting machine as in claim 1 wherein the water supply conduit is connected with the cutting head by means of a releasable coupling.

10. A cutting machine as in claim 1 wherein the outermost disc has an outwardly protruding annular rim engaging the cutting head with interposition of a slip ring sealing.

11. A cutting machine as in claim 2 wherein characterized in that the outermost disc is coupled to the bushing via claws.

12. A cutting machine as in claim 10 wherein the outermost disc is rotatably supported on the cutting head by means of a pivot bearing supported on the outer side of the outermost disc in proximity of the annular rim.

13. A cutting head for a cutting machine comprising a main body having an axis, about which said main body rotates during operation, and an internal axial cavity aligned therewith, means on one side of said main body for drivingly connecting said main body to a cutting arm; a disc assembly on the side opposite said one side of said main body, said disc assembly having a peripheral edge and a central bushing portion of reduced diameter which is fixed to said disc assembly and which is sealingly mounted for rotation within said axial cavity; and conduit means within said disc and said main body for supplying water to locations on the periphery of said main body when the latter is rotating and when said disc is not rotating, said conduit means including an axial bore in said disc assembly, a generally lateral bore extending between said axial bore near one end thereof and said peripheral edge of said disc assembly for connection to a water supply, a generally lateral bore in said bushing portion extending between said axial bore near the opposite end thereof and the periphery of said busing portion, said main body having an internal passage having an opening into said axial cavity and extending to a location for a water nozzle, said opening being located so as to move periodically into alignment with said bore in said bushing portion when said main body rotates relative to said disc assembly.

* * * * *